US007258571B1

(12) United States Patent
Chen

(10) Patent No.: US 7,258,571 B1
(45) Date of Patent: Aug. 21, 2007

(54) BATTERY CONNECTOR WITH RETAINING BOARD

(75) Inventor: Chung-Yu Chen, Tu-Cheng (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 0 days.

(21) Appl. No.: 11/384,787

(22) Filed: Mar. 21, 2006

(51) Int. Cl.
*H01R 3/00* (2006.01)

(52) U.S. Cl. ..... 439/500; 439/862; 439/289; 439/79

(58) Field of Classification Search ..... 439/289, 439/500, 79, 862
See application file for complete search history.

(56) References Cited

U.S. PATENT DOCUMENTS 5,971,775 A * 10/1999 Tor et al. ..... 439/79
6,315,620 B1 * 11/2001 Moir et al. ..... 439/862
6,875,049 B2 * 4/2005 Kyowski et al. ..... 439/500
7,029,287 B2 * 4/2006 Matsunaga et al. ..... 439/65

* cited by examiner

*Primary Examiner*—Tho D. Ta
(74) *Attorney, Agent, or Firm*—Rosenberg, Klein & Lee

(57) ABSTRACT

A battery connector with retaining board includes an insulating housing and a plurality of terminals received in the insulating housing. Each terminal includes a connecting portion, a contacting portion and a soldering portion. The insulating housing has a vertical cooperating wall. A top wall and a retaining board backward extend from the backside of the vertical cooperating wall, thereby a retaining space is formed therebetween. The backside of the cooperating wall defines a contacting side formed between the top wall and the retaining board. A printed circuit board is retained in the retaining space and one end of the printed circuit board is depressed against the contacting side of the insulating housing whereby a firmly engagement is between the printed circuit board and the battery connector. Therefore, an electrical connection therebetween is stable.

5 Claims, 6 Drawing Sheets

BATTERY CONNECTOR WITH RETAINING BOARD

BACKGROUND OF THE INVENTION

1. Field of the Invention

The present invention relates to a battery connector, and more particularly to a battery connector with retaining board.

2. The Related Art

A battery connector is widely used in a mobile phone or other electronic devices for electrically connecting a battery with a printed circuit board mounted in the mobile phone.

FIG. 6 shows a conventional battery connector. The battery connector 1 has an insulating housing 2 and a plurality of terminals 3 received in the insulating housing 2. The insulating housing 2 is mounted on an inner printed circuit board 4 of an electronic device. Each terminal 3 includes a contacting portion 6 and a soldering portion 7. The contacting portion 6 stretches out of the cooperating wall of the insulating housing 2 and contacts a battery 5, the soldering portion 7 stretches out of the bottom of the insulating housing 2 and contacts the printed circuit board 4.

However, the battery connector is electrically connected to the printed circuit board just by the soldering portions of the terminals contacting with the printed circuit board, there is no horizontal holding force between the battery and the printed circuit board. When the battery is horizontally depressed against the contacting portions of the terminals, a relative horizontal displacement is liable to be caused between the battery connector and the printed circuit board. As a result, the soldering portion of the terminals is easily to be loosened from the printed circuit board: therefore, the electrical connection between the battery connector and the printed circuit board is not stable. Such kind of loose situation also happen when the electronic device is struck.

SUMMARY OF THE INVENTION

Accordingly, an object of the present invention is to provide a battery connector with retaining board which providing a stable electrical connection to a printed circuit board. The battery connector with retaining board includes an insulating housing and a plurality of terminals. The insulating housing has a vertical cooperating wall. A plurality of receiving cavities are defined through the vertical cooperating wall. The terminals are received in the receiving cavities respectively. Each terminal includes a connecting portion, a contacting portion formed at one end of the connecting portion and a soldering portion formed at another end of the connecting portion opposite to the contacting portion. The contacting portion stretches out of the vertical cooperating wall after the terminals assembled with the insulating housing. The soldering portion is electrically connected to the printed circuit board. The backside of the vertical cooperating wall extends backward and defines a top wall and a retaining board respectively, thereby a retaining space is formed between the top wall and the retaining board. The backside of the vertical cooperating wall also forms a contacting side between the top wall and the retaining board. The printed circuit board is retained in the retaining space and one end of the printed circuit board depressed against the contacting side of the insulating housing, then the printed circuit board is retained stably in the battery connector.

When the battery is pressed against the contacting portion of the terminal backward, the printed circuit board is depressesed toward the vertical cooperating wall at the same time. Moreover, the printed circuit board is retained firmly by the retaining board and the top wall. As a result, the battery connector with retaining board can avoid a relative horizontal displacement between the battery connector and the printed circuit board, and avoid the soldering portion of the terminals being loosened from the printed circuit board. Therefore, the electrical connection between the battery connector and the printed circuit board is stable.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE PREFERRED EMBODIMENT

Figure 1:
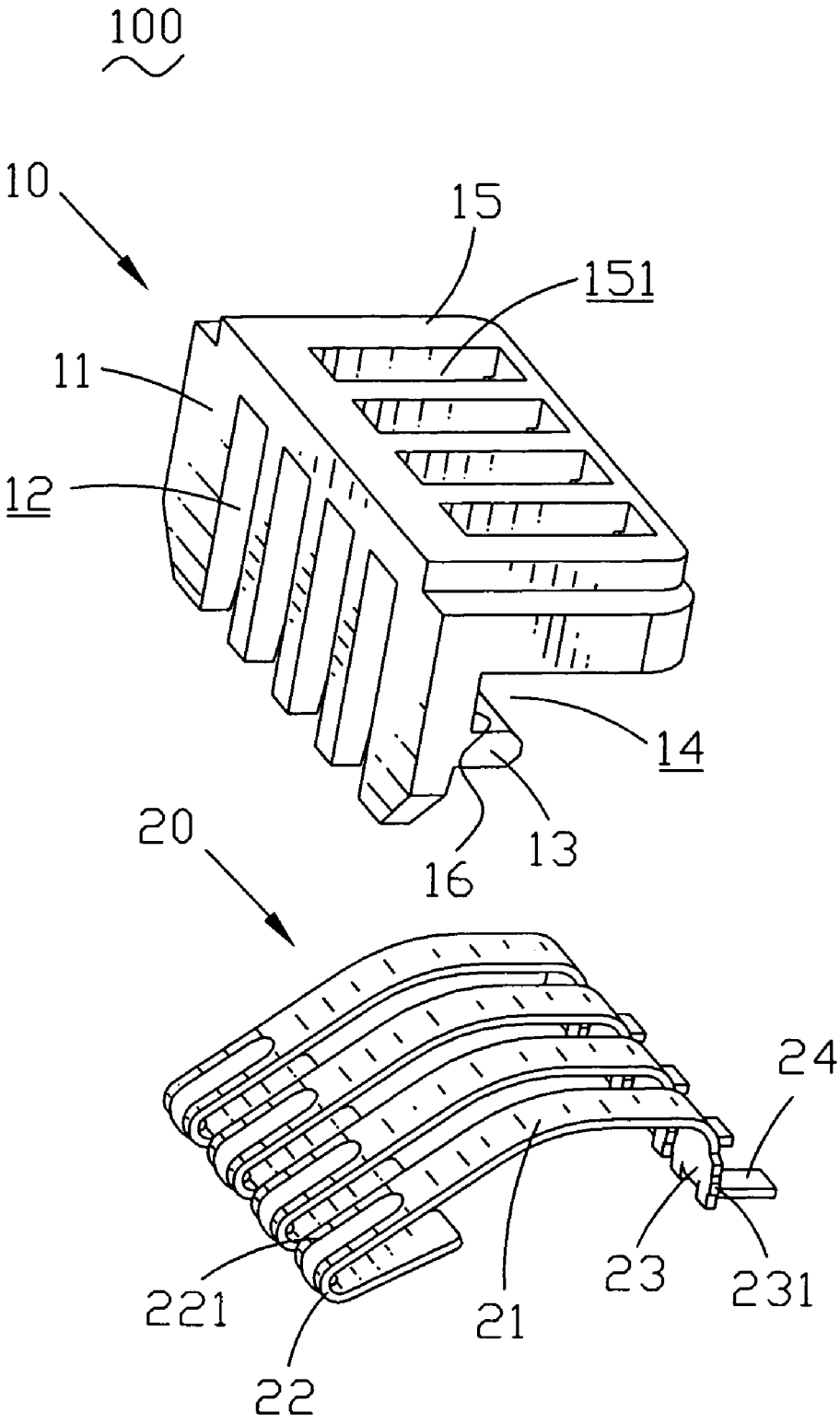
FIG. 1 is an exploded view of the battery connector with retaining board of the present invention.
Figure 2:
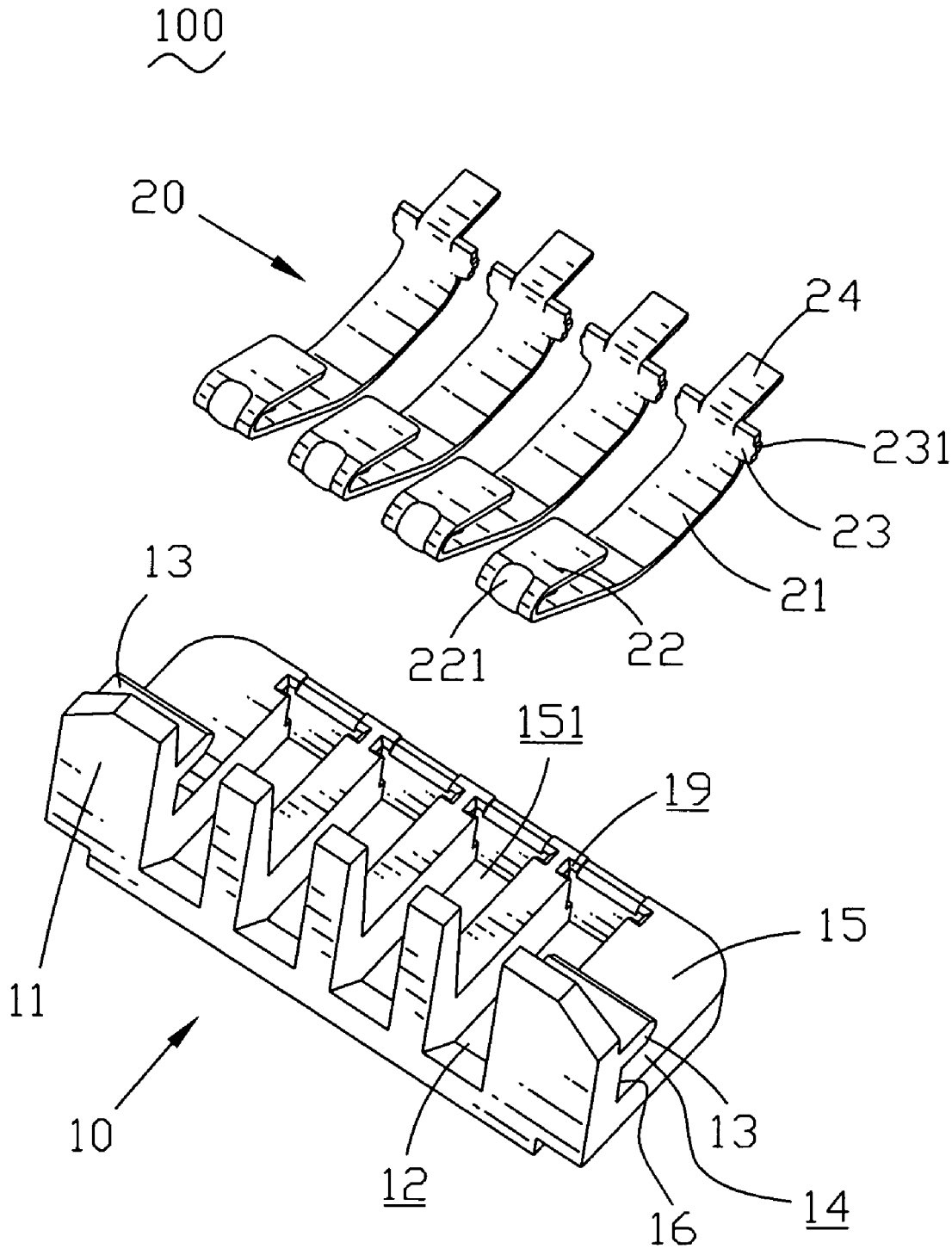
FIG. 2 is an exploded view of the battery connector with retaining board viewing from bottom side.

Please refer to FIGS. 1 and 2. A battery connector with retaining board 100 includes an insulating housing 10 and a plurality of terminals 20 received in the insulating housing 10.

The insulating housing 10 includes a vertical cooperating wall 11 and a top wall 15 horizontally extending backward from the top of the vertical cooperating wall 11. A plurality of receiving cavities 12 are transversally arranged through the vertical cooperating wall 11 and are parallel to each other. A retaining board 13 horizontally extends backward from the middle of the vertical cooperating wall 11, thereby, a retaining space 14 is formed between the retaining board 13 and the top wall 15. The height of the retaining space 14 is substantially equal to the thickness of a printed circuit board. A contacting side 16 is formed on the backside of the vertical cooperating wall 11 and located between the top wall 15 and the retaining board 13. A plurality of holding cavities 151 are defined through the top wall 15. Each holding cavity 151 communicates with a receiving cavity 12 respectively. An inlaying slot 19 is vertically defined through the top wall 15 at the back end of each holding cavity 151 and communicates with the holding cavity 151.

Each terminal 20 includes a connecting portion 21, a U-shaped contacting portion 22 extending from the front end of the connecting portion 21 and a blocking portion 23 extending from the back end of the connecting portion 21. The out surface of the contacting portion 22 defines a contacting point 221 for electrically connecting to a battery. Each side of the blocking portion 23 extends and defines a flange 231 respectively. The back end of the blocking portion 23 extends backward horizontally and defines a plane soldering portion 24 for electrically connecting to a printed circuit board 30 (shown in FIG. 4).

Figure 3:
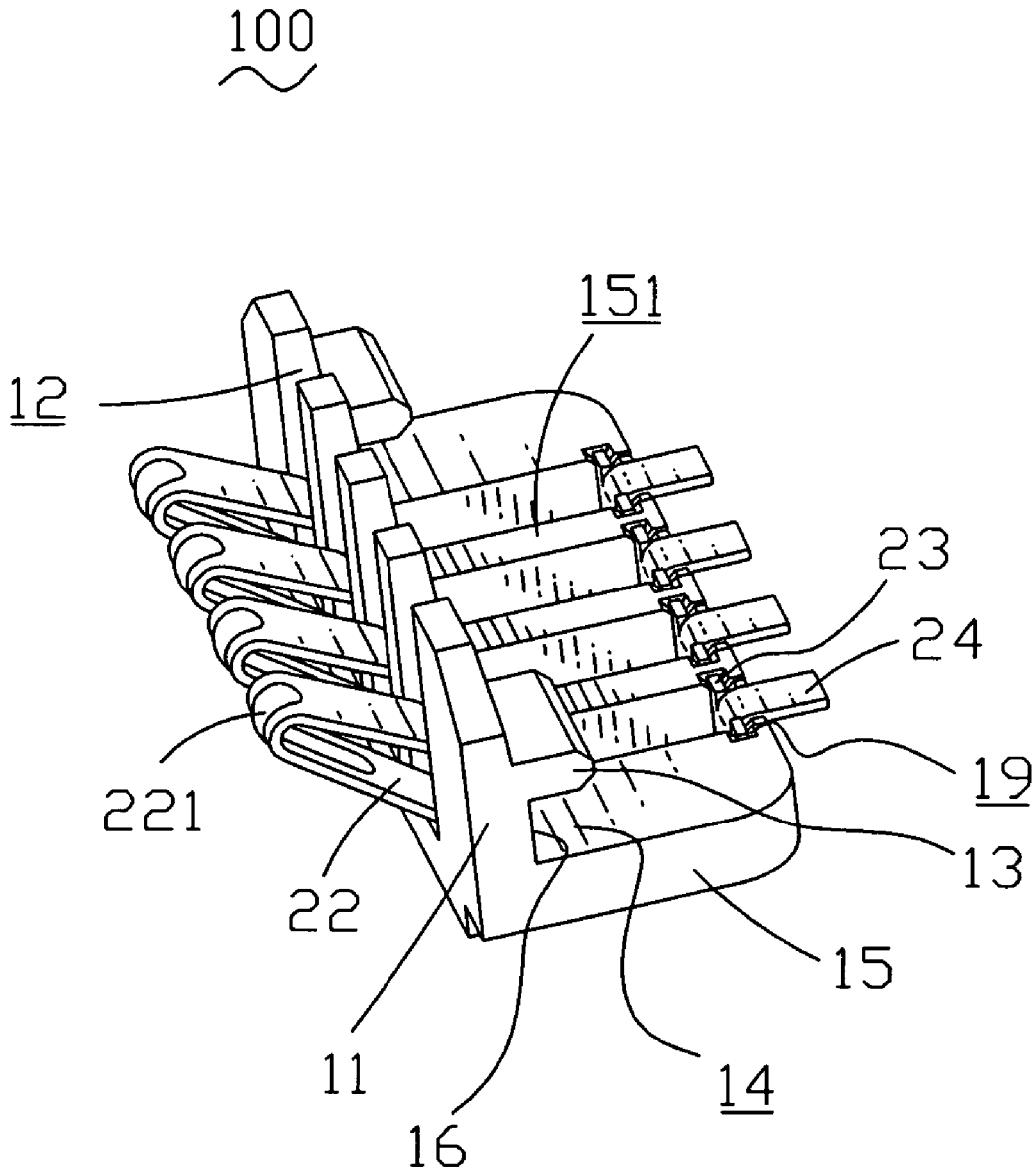
FIG. 3 is a perspective assembled view of FIG. 2.

Please refer to FIGS. 2-3. When the battery connector with retaining board 100 is assembled, firstly, the contacting portion 22 of the terminal 20 is inserted into the receiving cavity 12 of the insulating housing 10. Secondly, the connecting portion 21 is held in the holding cavity 151 and the flange 231 is inlaid in the inlaying slot 19. Then, the assembly of the battery connector with retaining board 100 is completed. The contacting portion 22 of the terminal 20 stretches out of the vertical cooperating wall 11 and the soldering portion 24 stretches out of the bottom of the top wall 15.

Figure 4:
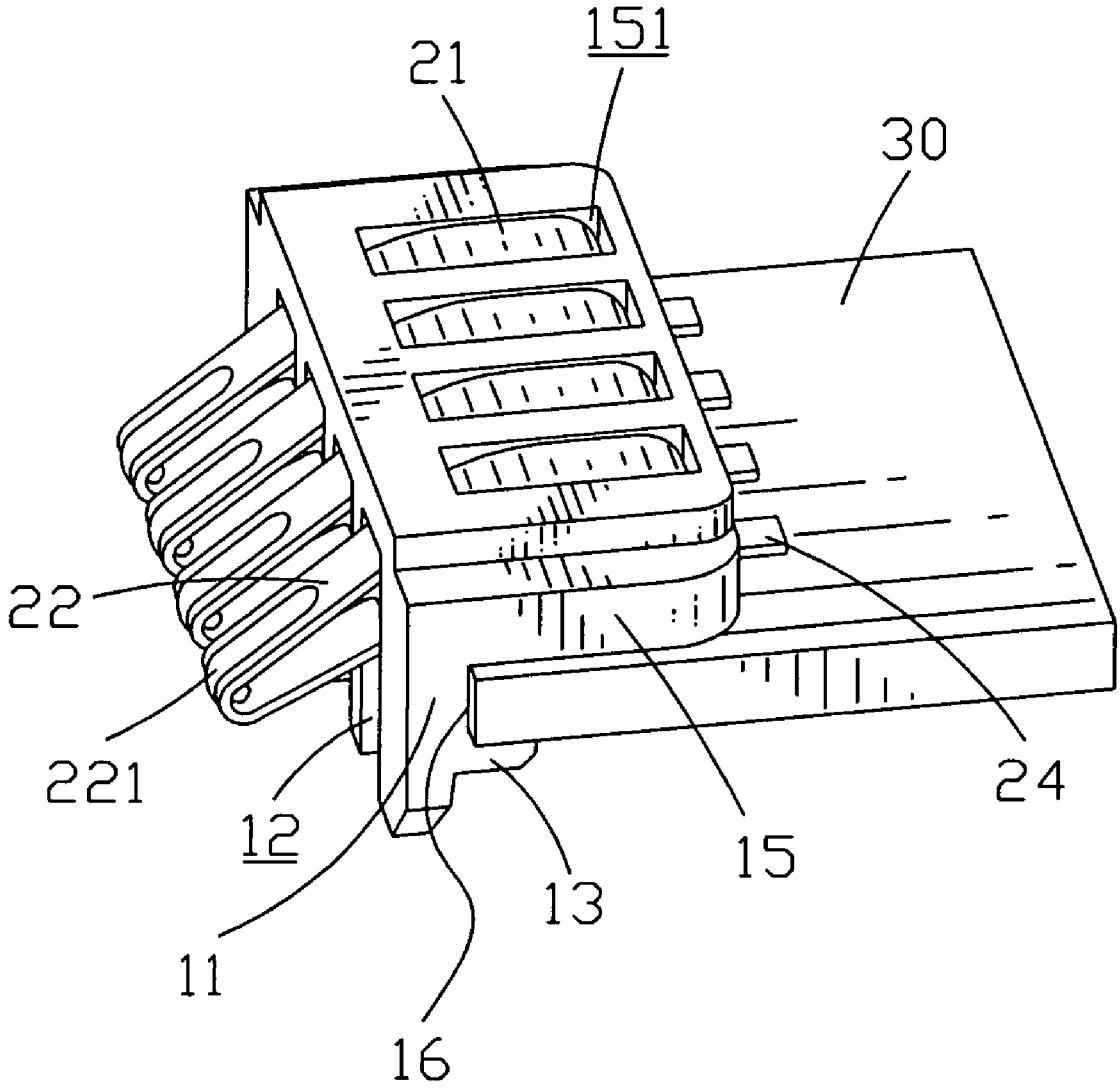
FIG. 4 is a perspective view of the battery connector with retaining board, showing a printed circuit board assembled in the battery connector.

Referring to FIG. 4, the printed circuit board 30 is inserted into the retaining space 14. One end of the printed circuit board 30 is pressed against the contacting side 16 of the insulating housing 10, and the soldering portion 24 of the terminal 20 contacts the printed circuit board 30, thereby, the battery connector with retaining board 100 is electrically connected to the printed circuit board 30.

Figure 5:
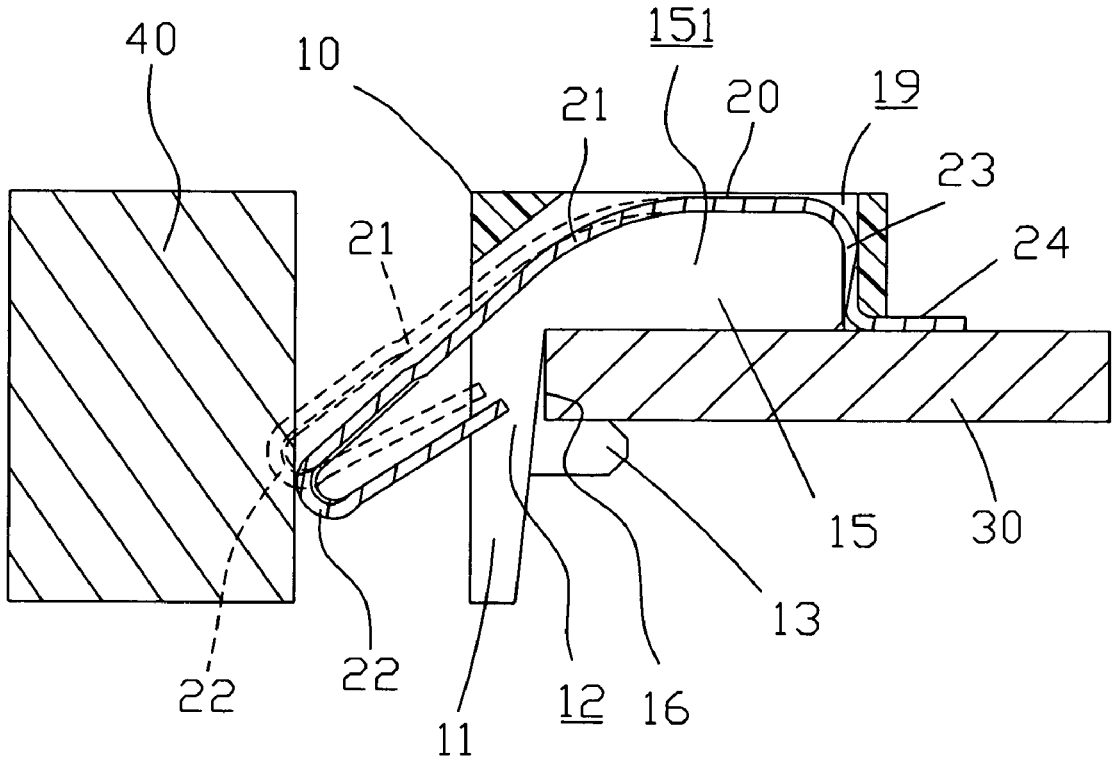
FIG. 5 is a cross-sectional view of the battery connector with retaining board, showing a printed circuit board assembled in the battery connector and a battery partially pressing the battery connector.
Figure 6:
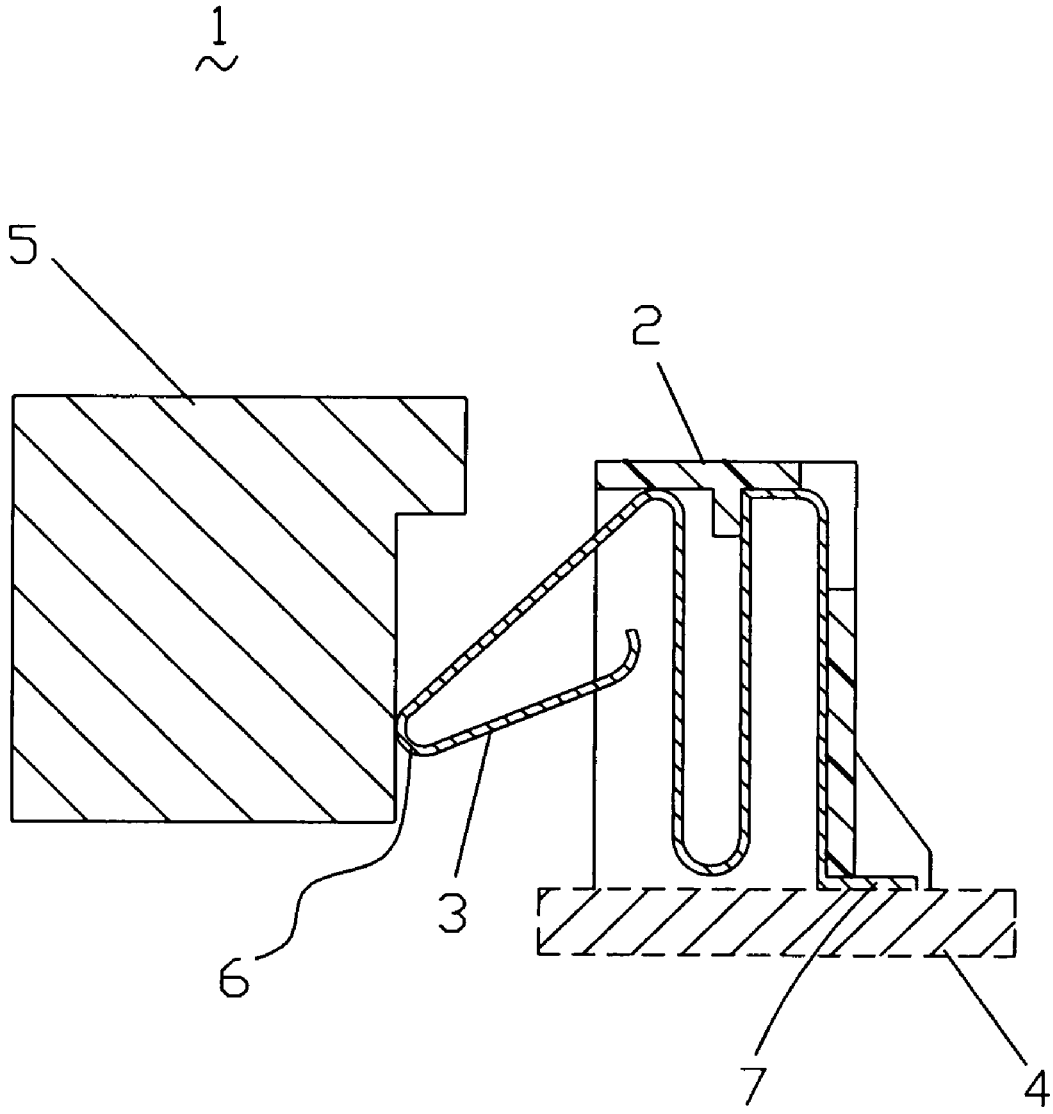
FIG. 6 (Prior Art)
FIG. 6 shows conventional battery connector.

Please refer to FIG. 5. In use, when the battery 40 connects to the battery connector with retaining board 100, the contacting portion 22 of the terminal 20 is depressed inwardly, and therefore the battery connector with retaining board 100 is displaced backward and horizontally by the battery 40. At the same time, a horizontal counterforce is generated through the terminals 20 and cause the printed circuit board 30 being depressed toward the vertical cooperating wall 11 of the battery connector. As a result, a relative horizontal displacement is incapable to be caused between the battery connector with retaining board 100 and the printed circuit board 30. The printed circuit board 30 is firmly retained in the retaining space by the retaining board 13 and the top wall 15 and has a reliable connection with the soldering portions 24 Accordingly, the electrical connection between the battery connector with retaining board 100 and the printed circuit board 30 is stable and the transportation of the electrical signal is also stable.

The foregoing description of the present invention has been presented for purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. A battery connector with retaining board comprising:

an insulating housing having a vertical cooperating wall, a top wall, a retaining board extending backward from the backside of the vertical cooperating wall to form a retaining space for receiving a printed circuit board, a plurality of receiving cavities being vertically defined through the vertical cooperating wall, and a contacting side being formed on the backside of the vertical cooperating wall and located between the top wall and the retaining board for contacting the printed circuit board; and a plurality of terminals received in the receiving cavities, each terminal including a connecting portion, a contacting portion defined at one end of the connecting portion, and a soldering portion defined at another end of the connecting portion opposite to the contacting portion; the contacting portion stretching out of the receiving cavity after the terminals assembled with the insulating housing.

2. The battery connector with retaining board as claimed in claim 1, wherein the out surface of the contacting portion defines a contacting point for electrically connecting to a battery.

3. The battery connector with retaining board as claimed in claim 1, wherein the height of the retaining space substantially is equal to the thickness of the printed circuit board.

4. The battery connector with retaining board as claimed in claim 1, wherein a plurality of holding cavities are defined through the top wall, each holding cavity communicates with the receiving cavity respectively, the connecting portion of the terminal is received in the holding cavity.

5. The battery connector with retaining board as claimed in claim 4, wherein the connecting portion further has a blocking portion perpendicularly bent from one end thereof, the soldering portion integrally bent from one end of the blocking portion for soldering with the printed circuit board; an inlaying slot is vertically defined through the top wall and communicates with the holding cavity, wherein the blocking portion of the terminal is inlaid in the inlaying slot.

* * * * *